United States Patent [19]

Salentine et al.

[11] 4,384,967

[45] May 24, 1983

[54] LUBRICANT COMPOSITION CONTAINING AN ALKALI METAL BORATE AND A SULFUR-CONTAINING POLYHYDROXY COMPOUND

[75] Inventors: Christopher G. Salentine, Walnut Creek; Vernon R. Small, Rodeo, both of Calif.

[73] Assignee: Chevron Research Company, San Francisco, Calif.

[21] Appl. No.: 288,228

[22] Filed: Jul. 29, 1981

[51] Int. Cl.[3] ..... C10M 1/54; C10M 1/38

[52] U.S. Cl. ..... 252/48.4; 252/25; 252/48.2; 252/49.6

[58] Field of Search ..... 252/48.4, 48.2, 25, 252/49.6

[56] References Cited

U.S. PATENT DOCUMENTS

| | | | |
|---|---|---|---|
| 2,174,248 | 9/1939 | Mikeska et al. | 252/48.2 X |
| 2,916,519 | 12/1959 | Wegner et al. | 252/48.2 X |
| 3,005,853 | 10/1961 | Wilgus et al. | 252/48.2 X |
| 3,565,802 | 2/1971 | West et al. | 252/25 |
| 3,819,521 | 6/1974 | Sims | 252/33 X |
| 3,846,313 | 11/1974 | Sims | 252/25 X |
| 4,163,729 | 8/1979 | Adams | 252/25 X |

FOREIGN PATENT DOCUMENTS

| | | | |
|---|---|---|---|
| 1311402 | 10/1961 | France | 252/48.2 |
| 633993 | 12/1949 | United Kingdom | 252/48.2 |

*Primary Examiner*—Andrew Metz

*Attorney, Agent, or Firm*—D. A. Newell; J. M. Whitney; J. J. DeYoung

[57] ABSTRACT

Disclosed is a lubricant composition containing an oil of lubricating viscosity having dispersed therein a particulate hydrated alkali-metal borate and an effective amount of a sulfur-containing polyhydroxy compound which stabilizes the composition against the adverse effects of water contamination.

9 Claims, No Drawings

LUBRICANT COMPOSITION CONTAINING AN ALKALI METAL BORATE AND A SULFUR-CONTAINING POLYHYDROXY COMPOUND

BACKGROUND OF THE INVENTION

The invention relates to extreme pressure lubricating oils, particularly alkali metal borate-containing lubricants.

Alkali metal borate-containing lubricants are well known in the art for their usefulness as extreme pressure lubricating oils. See, for example, U.S. Pat. Nos. 3,313,727, 3,565,802, 3,819,521, 3,846,313, 3,853,772, 3,907,691, 3,912,639, 3,912,643, 3,912,644, 3,997,454, and 4,089,790.

The borate-containing oils, described in these patents, have a serious deficiency in service. If water is introduced into the system containing the borate lubricant, the borate crystallizes out of the oil and forms hard granules. It has been found that water contamination of the borate lubricant can lead to seal leakage. It is believed that the crystallization is caused by water contamination which leads to the formation of deposits on shafts at or near the seals. The turning motion of the shafts then slowly abrades the seals, thereby allowing loss of the lubricant.

U.S. Pat. No. 3,997,454 claims a hydrated potassium borate with a boron-to-potassium ratio of 2.5 to 3.5 as being superior to other alkali metal borates in resisting the adverse effects of water contamination.

U.S. Pat. No. 3,819,521 claims a hydrated sodium borate and $C_3$–$C_6$ polyol containing lubricant having superior extreme pressure and water tolerance properties.

It is one object of the present invention to provide an alkali metal borate-containing lubricant having improved resistance to the adverse effects of water contamination.

SUMMARY OF THE INVENTION

It has been found that the addition of an effective amount of a sulfur-containing polyhydroxy compound to a lubricating oil containing an alkali metal borate prevents the accumulation of seal damaging deposits caused by water contamination of the lubricant.

DETAILED DESCRIPTION OF THE INVENTION

The lubricant composition comprises an oil of lubricating viscosity, particulate hydrated alkali metal borate and an effective amount of a sulfur-containing polyhydroxy compound.

THE ALKALI-METAL BORATES

The hydrated particulate alkali-metal borates are well known in the art and are available commercially. Representative patents disclosing suitable borates and methods of manufacture include: U.S. Pat. No. 3,313,727; 3,819,521; 3,853,772; 3,997,601; 3,997,454; and 4,089,790, the entire disclosures of which are incorporated herein by reference.

The hydrated alkali-metal borates can be represented by the following formula:

$$M_2O.mB_2O_3.nH_2O$$

where M is an alkali metal of atomic number in the range 11 to 19, i.e., sodium and potassium, m is a number from 2.5 to 4.5 (both whole and fractional), and n is a number from 1.0 to 4.8. Preferred are the hydrated potassium borates, particularly the hydrated potassium triborates microparticles having a boron-to-potassium ratio of about 2.5 to 4.5. The hydrated borate particles generally have a mean particle size of less than 1 micron.

The alkali-metal borate will generally comprise 0.1 to 60 weight percent of the lubricant, preferably 0.5 to 15 weight percent.

THE SULFUR-CONTAINING POLYHYDROXY COMPOUNDS

The lubricant composition contains an effective amount of a sulfur-containing polyhydroxy compound to prevent the accumulation of seal damaging borate deposits caused by water contamination of the lubricant. Generally the lubricant will contain 0.01 to 5.0 weight percent of the sulfur-containing polyhydroxy compound and preferably 0.1 to 2.0 weight percent.

Representative sulfur-containing polyhydroxy compounds include:

3,4-dihydroxy-2-thiabutanol;
4,4-dimethylol-2-thiapentanol;
2,2-dimethylol-3-thiahexanol;
5-thiadodecane-1,2-diol;
3,4,5,6-tetrahydroxy-2-thiaheptanol;
6-thiatetradecane-1,2-diol;
4-thiapentadecane-1,2-diol;
3-thiahexadecane-1,2-diol;
4-thiahexadecane-1,2-diol;
4,4-dimethyl-3-thiaoctadecane-1,2-diol;
1,1,1-trimethylol-2-thiapropane monooleate;
3,6-oxathiaoctane-1,8-diol;
6,6,6-trimethylol-2,5-oxathiahexane;
3-(phenylthio)-1,2-propanediol;
4-thiadocosane-1,2-diol
4-thiaoctane-1,2-diol
4-thiaeicosane-1,2,6-triol.

One class of preferred sulfur-containing polyhydroxy compounds may be represented by the following formula:

$$(C_nH_xS)(OH)_2$$

wherein:

n is 7 to 30; x is n to 2n.

Particularly preferred are the sulfur-containing polyhydroxy compounds where n is 9 to 21 and x is 2n. Another class of preferred compounds are those containing one phenyl ring. Most preferred are thioethers containing at least 2 hydroxy groups, particularly when two of the hydroxy groups are on adjacent carbon atoms. Mixtures of several carbon number sulfur-containing polyhydroxy compounds are also effective.

The lubricating oil to which the borates and the sulfur-containing polyhydroxy compound are added, can be any hydrocarbon-based lubricating oil or a synthetic base oil stock. The hydrocarbon lubricating oils may be derived from synthetic or natural sources and may be paraffinic, naphthenic or asphaltic base, or mixtures thereof. A variety of other additives can be present in lubricating oils of the present invention. These additives include antioxidants, viscosity index improvers, dispersants, rust inhibitors, foam inhibitors, corrosion inhibitors, other antiwear agents, and a variety of other well-known additives. Particularly preferred additional additives are the oil-soluble succinimides and oil-soluble alkali or alkaline earth metal sulfonates.

EXAMPLES

To 100 ml samples of a base oil containing 8.7 weight percent of a potassium triborate dispersion, 1.0 weight percent of a diparaffin polysulfide, 0.5 weight percent zincdialkyldithiophosphate, and 0.5 weight percent of a phenolic antioxidant were added various amounts of sulfur-containing polyhydroxy compounds. Each sample was tested in a seal leakage apparatus comprising a sealed motor driven metal shaft passing through a reservoir of test oil. The seal comprised a Chicago Rawhide 10700 lip seal. Provisions were made for collecting any oil leakage. The shaft was rotated at 3600 revolutions per minute in each test. Each experiment was four hours long, started at room temperature, and test oil temperature rose to 70° C. (158° F.) in the first 60 minutes. New Chicago Rawhide 10700 lip seals were used for each test. After each experiment was complete, the amount of oil leakage, the seal wear, the shaft deposit weight, and the presence of ridges at the seal shaft contact line were recorded. Shaft ridges were evaluated visually and tactilely and rated as none, light, moderate, or heavy. Formulations showing none or light ridges are considered satisfactory. The results are reported in Table I.

TABLE I

PROPERTIES OF BORATE DISPERSION CONTAINING WATER

| Additive | Water Level, % | Seal Wear, $10^{-3}$ In. | Deposit Weight, mg | Leakage, ml | Shaft Ridges |
|---|---|---|---|---|---|
| None | 0 | 14 | 0 | 0 | none |
| None | 0 | 13 | 0 | 0 | none |
| None | 1 | 24 | 30 | 20 | heavy |
| 0.5% glycerol | 1 | 14 | 9 | 0 | light |
| 0.5% glycerol | 1 | 10 | 11 | 0 | light |
| 0.5% 2-ethyl-1,3-hexanediol | 1 | 15 | 10 | 0 | light |
| 0.5% 4-thiahexadecane-1,2-diol | 1 | 8 | 5 | 0 | none |
| 0.25% 3-(phenylthio)-1,2-propanediol | 1 | 8 | 5 | 0 | none |
| 0.5% 3-(phenylthio)-1,2-propanediol | 1 | 13 | 4 | 0 | none |
| 0.5% 4-thiaoctane-1,2-diol | 1 | 14 | 7 | 0 | none |
| 0.5% 4-thiadocosane-1,2-diol | 1 | 7 | 5 | 0 | none |
| 0.5% 6-$C_{13-16}$ alkyl-4-thiahexane-1,2,6-triol | 1 | 7 | 24 | 0 | none |

The above data demonstrates that water contamination of a borate-containing lubricant causes substantial seal deterioration due to deposits formed in ridges at the seal shaft contact line which eventually leads to seal leakage whereas the sulfur-containing polyhydroxy compounds of the present invention are effective in substantially improving the water contamination resistance of an alkali-metal borate-containing lubricant. Furthermore, the data indicates that the sulfur-containing polhydroxy compounds are superior to polyhydroxy compounds that do not contain sulfur.

What is claimed is:

1. A lubricant composition comprising an oil of lubricating viscosity having dispersed therein:
   (a) 0.1 to 60 weight percent of a particulate hydrated alkali-metal borate and
   (b) an effective amount of a sulfur-containing polyhydroxy compound to prevent the accumulation of seal damaging borate deposits, wherein said sulfur-containing polyhydroxy compound is selected from 4-thiahexadecane-1,2-diol, 3-(phenylthio)-1,2-propanediol, 4-thiaoctane-1,2-diol, 4-thiadocosane-1,2-diol, and 6-$C_{13-16}$ alkyl-4-thiahexane-1,2,6-triol.

2. The lubricant composition of claim 1 having dispersed therein 0.01 to 5.0 weight percent of said sulfur-containing polyhydroxy compound.

3. The lubricant composition of claim 1 having dispersed therein 0.1 to 2.0 weight percent of said sulfur-containing polyhydroxy compound.

4. The lubricant composition of claim 1 wherein said alkali metal borate is a potassium triborate.

5. A lubricant composition comprising an oil of lubricating viscosity having dispersed therein:
   (a) 0.1 to 60 weight percent of a particulate hydrated alkali-metal borate and
   (b) an effective amount of a sulfur-containing polyhydroxy compound to prevent the accumulation of seal damaging borate deposits, wherein said polyhydroxy compound is of the formula:

$$(C_nH_xS)(OH)_2$$

wherein:

n is 7 to 30, and x is n to 2n.

6. The lubricant composition of claim 5 having dispersed therein 0.01 to 5.0 weight percent of said sulfur-containing polyhydroxy compound.

7. The lubricant composition of claim 5 having dispersed therein 0.1 to 2.0 weight percent of said sulfur-containing polyhydroxy compound.

8. The lubricant composition of claim 5 wherein in the formula n is 9 to 21 and x is 2n.

9. The lubricant composition of claim 5 wherein said alkali metal borate is a potassium triborate.

* * * * *